US005753338A

United States Patent [19]

Jelic et al.

[11] Patent Number: 5,753,338

[45] Date of Patent: May 19, 1998

[54] HONEYCOMB AND METHOD OF MAKING SAME

[75] Inventors: Ralph Jelic, Valencia, Pa.; Ad Verkuyten, Hengelo, Netherlands

[73] Assignee: Verosol USA Inc., Pittsburgh, Pa.

[21] Appl. No.: 517,096

[22] Filed: Aug. 21, 1995

[51] Int. Cl.[6] ..... B32B 7/08

[52] U.S. Cl. ..... 428/116; 428/119; 428/178; 428/225; 139/35; 139/384 A

[58] Field of Search ..... 160/84.01, 84.05; 66/84 R; 428/116, 119, 59, 178, 225; 139/35, 384 A

[56] References Cited

U.S. PATENT DOCUMENTS

| | | | |
|---|---|---|---|
| 3,309,900 | 3/1967 | Wusch et al. | 66/85 |
| 3,603,114 | 9/1971 | Jaskulski | 66/85 |
| 4,450,027 | 5/1984 | Colson | 156/193 |
| 4,673,600 | 6/1987 | Anderson | 428/12 |
| 4,676,855 | 6/1987 | Anderson | 156/193 |
| 5,188,160 | 2/1993 | Jelic | 160/84 |
| 5,313,999 | 5/1994 | Colson | 160/121.1 |
| 5,339,882 | 8/1994 | Judkins | 160/84 |

OTHER PUBLICATIONS

Spacer fabrics (6 pages), Mar. 1, 1994.

Part III, Three Dimensional Structures.

Malimo Maschinenbrau GmbH catalog, Stitch-Bonding Machines Web-Based Technology, Aug., 1991.

Malimo Machinenbrau GmbH catalog Manufacture of Fabrics for Automotive Interior Using the Wrap Knitting and Stitchbonding Process, Aug., 1993.

Malmo Machinenbrau GmbH catalog, Kunit—a Web Knitting Process based on Malimo Stitch-Bonding Technique, Mar., 1993.

*Primary Examiner*—Timothy Speer

*Attorney, Agent, or Firm*—Buchanan Ingersoll, P.C.

[57] ABSTRACT

A honeycomb structure particularly useful for window coverings is made by simultaneously knitting or weaving a front sheet, a rear sheet and a plurality of webs therebetween. A warp knitting process is used to make the front sheet and rear sheet. At least one warp thread from one sheet is threaded through the opposite sheet to form the webs. Preferably, a wood, metal, textile or plastic slat is placed on each web.

20 Claims, 13 Drawing Sheets

HONEYCOMB AND METHOD OF MAKING SAME

FIELD OF INVENTION

The invention relates to a honeycomb structure suitable for use as a window covering and a method of making the honeycomb structure.

BACKGROUND OF THE INVENTION

One well-known type of window treatment is the honeycomb window shade. In a honeycomb structure there are a series of cells defined by a front face, rear face and a plurality of webs running between the front face and the rear face. Depending on the number of cells which may be found in a transverse cross section through the shade from front to back, the honeycomb may be a single cell honeycomb, or multiple cell honeycomb structure. Window coverings are available in a single cell, double cell and triple cell structures.

The art has developed a variety of ways of manufacturing honeycomb shades. In one method there is provided a front sheet, a back sheet and a series of horizontal webs each web having one edge glued to the front sheet and an opposite edge glued to the back sheet. Examples of this type of honeycomb can be found in U.S. Pat. Nos. 5,188,160 to Jelic and 5,339,882 to Judkins. Honeycombs have also been formed by connecting the opposite noses of a pleated front sheet and a pleated back sheet together to form cells. Examples of this structure are disclosed in U.S. Pat. No. 4,673,600. It has also been proposed to make a honeycomb shade using a series of Z-folded strips which have been glued together to form a honeycomb structure. This is disclosed in U.S. Pat. No. 4,676,855 to Anderson. Another method to form a honeycomb is to glue together a series of stacked tubes, each tube being formed from a strip of fabric having its opposite sides connected together. Examples of this type of honeycomb structure are shown in U.S. Pat. No. 4,450,027 to Colson. All of the honeycomb window treatments of the prior art are made with at least two discrete pieces of fabric which are then connected together. None of the honeycomb structures are made by simultaneously knitting or weaving the front sheet, back sheet and webs therebetween.

It is also well-known in the art to make the front sheet of a honeycomb product of a different material from a back sheet of honeycomb product. Furthermore, Colson in U.S. Pat. No. 5,313,999 discloses making the front sheet and back sheet of a honeycomb product of a translucent material and the webs of an opaque material. In this type of honeycomb the front sheet can also be moved relative to the back sheet so that the webs are perpendicular to the front and back sheet thereby allowing light to pass through the front sheet and back sheet. The front sheet can also be moved relative to the back sheet so as to place webs substantially parallel to the front and back sheet. Since the webs are made of a light blocking material, light can not pass through the honeycomb structure when the webs are substantially parallel to the front and back sheets.

The knitting art has developed a method of weaving fabric known as the warp process. In this method a set of substantially parallel top threads is overlaid on a set of substantially parallel base threads to form a mesh. Typically, the top threads are oriented at a 90° angle relative to the base threads. Then a warp thread is woven through the mesh to join the top threads to the base threads. It is also possible to make a fabric using only one set of parallel threads through which the warp threads are woven. A warp knitting machine which practices the warp knitting method is disclosed in U.S. Pat. No. 3,603,114. The art has developed a number of variations in the warp knitting process to create three-dimensional structures. Generally, these structures are made from a set of parallel mesh which are knitted together on a warp knitting machine. The two parallel mesh may be tightly or loosing joined to one another depending upon the application. Malimo Machinenbrau GmbH has developed machinery for manufacturing a variety of such three-dimensional structures in conjunction with Karl Mayer Textilmachinenfabrik GmbH. In the Karl Mayer and Malimo structures the front mesh and back mesh are relatively close together, usually not more than an inch apart. A principal application for the spaced apart structure is as an interior wall covering for automobiles. The warp knitting process has not been used to manufacture honeycomb structures suitable for use as window treatments.

SUMMARY OF THE INVENTION

I provide a honeycomb structure and method of manufacture which uses an improved warp knitting technique to simultaneously knit the front sheet, rear sheet and spaced apart webs that form the honeycomb structure. In this technique a front mesh and rear mesh are provided in a spaced apart relationship. At least one warp thread is directed by weaving or knitting through the front sheet to join the mesh together. A second warp thread is directed through the rear mesh holding that together. At spaced apart intervals the front warp thread or rear warp thread or both are crossed over to the opposite mesh thereby forming a web at each interval. The process is continued to simultaneously knit the front sheet, rear sheet and spaced apart webs. The spaced apart sheets and the webs can be knitted to have any desired level of light transmissive quality. I prefer that the front sheet and rear sheet be light transmissive and that the webs be an open weave. I further prefer to provide for the placement of wood, metal, textile or plastic slats on the webs, or to use no slats at all. I further prefer that the slats placed on the webs to be opaque. In this structure when the front sheet is oriented relative to the back sheet so that the webs are perpendicular to the front and back sheet light will pass through the honeycomb. When the front sheet is moved relative to the back sheet so that the webs are approximately parallel to the front and back sheet, light will not pass through the honeycomb.

Other objects and advantages of the invention will become apparent in a description of certain present preferred embodiments shown in the drawings.

DESCRIPTION OF THE PREFER EMBODIMENTS

Figure 1:
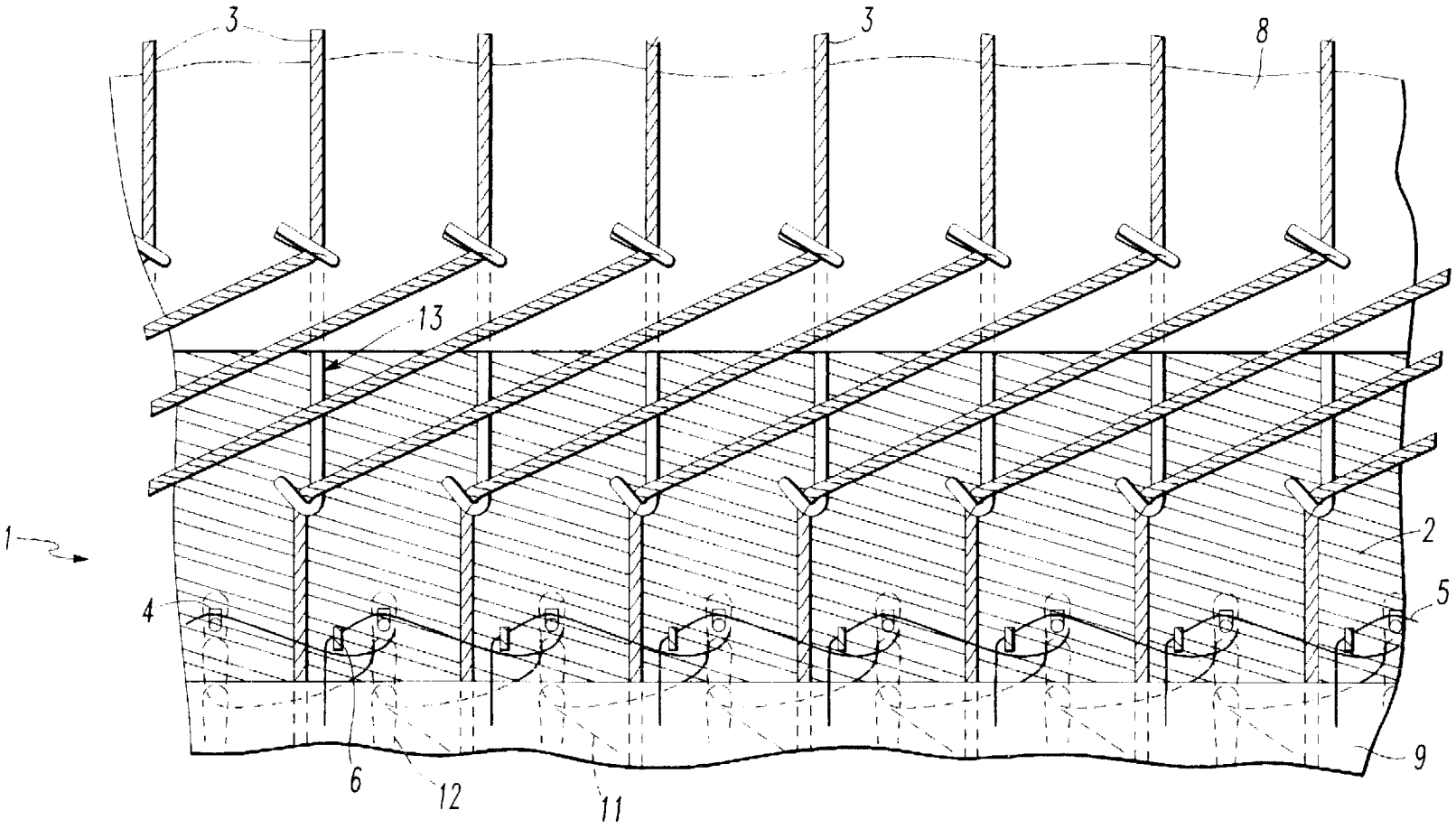
FIG. 1 is a diagram illustrating the forming of a sheet of fabric utilizing the warp knitting technique.

Referring to FIG. 1 I provide a mesh 1 comprised of a set of parallel base threads 2 shown oriented in a generally horizontal position. A set of top threads 3 is overlaid onto the base threads. The mesh is carried on movable support bars 8 and 9. A plurality of reciprocating warp needles 4 are fed with warp threads 5 supplied through feed guides 6. In the particular embodiment shown, base threads 2 consist of transverse threads which are connected with each other by the knitted fabric being formed by warp threads 5. For making the material the feed guide 6 feeds alternate warp threads 5 over two adjacent needles 4. The needles move the threads to form knitted stitches 12 of the warp-knitted fabric on the rear face of base material 2 and sinker meshes 11 on the front face thereof. Thus, base material 2 is deposited between knitted stitches 12 and sinker meshes 11 of the warp-knitted material. Sinker meshes 11 extend above two adjacent warp loops and serve to tie loose top threads 3 to the front face of the base material 6. For guiding loose warp threads 3, thread guides 13 are provided and are deposed on a support 8. Support 8 is arranged above the stitch-forming location in front of base material 2. During the rearward movement of needles 4, base material 2 is supported by a stripping comb (not shown). During the forward movement of the needles 1, the base material is supported by the supporting bar 9. In that way the stripping comb and the supporting bar 9 form a locking means for the base material 2. If desired the base threads 2 may be of the same or a different material as the top threads 3 and warp threads 5. Furthermore, the warp technique shown in FIG. 1 could be used to weave a fabric using only the base threads 2 and not the top threads 3. For ease of description the term mesh is used herein to refer to any set of threads through which warp threads are directed. This mesh could be comprised of one, two or more sets of substantially parallel threads. Those skilled in the art will recognize that the warp threads can be directed through the mesh using either a knitting or weaving process. Although the present preferred embodiments are described in the context of knitting, it should be understood that the invention is not limited to knitted structures and knitting techniques.

Figure 2:
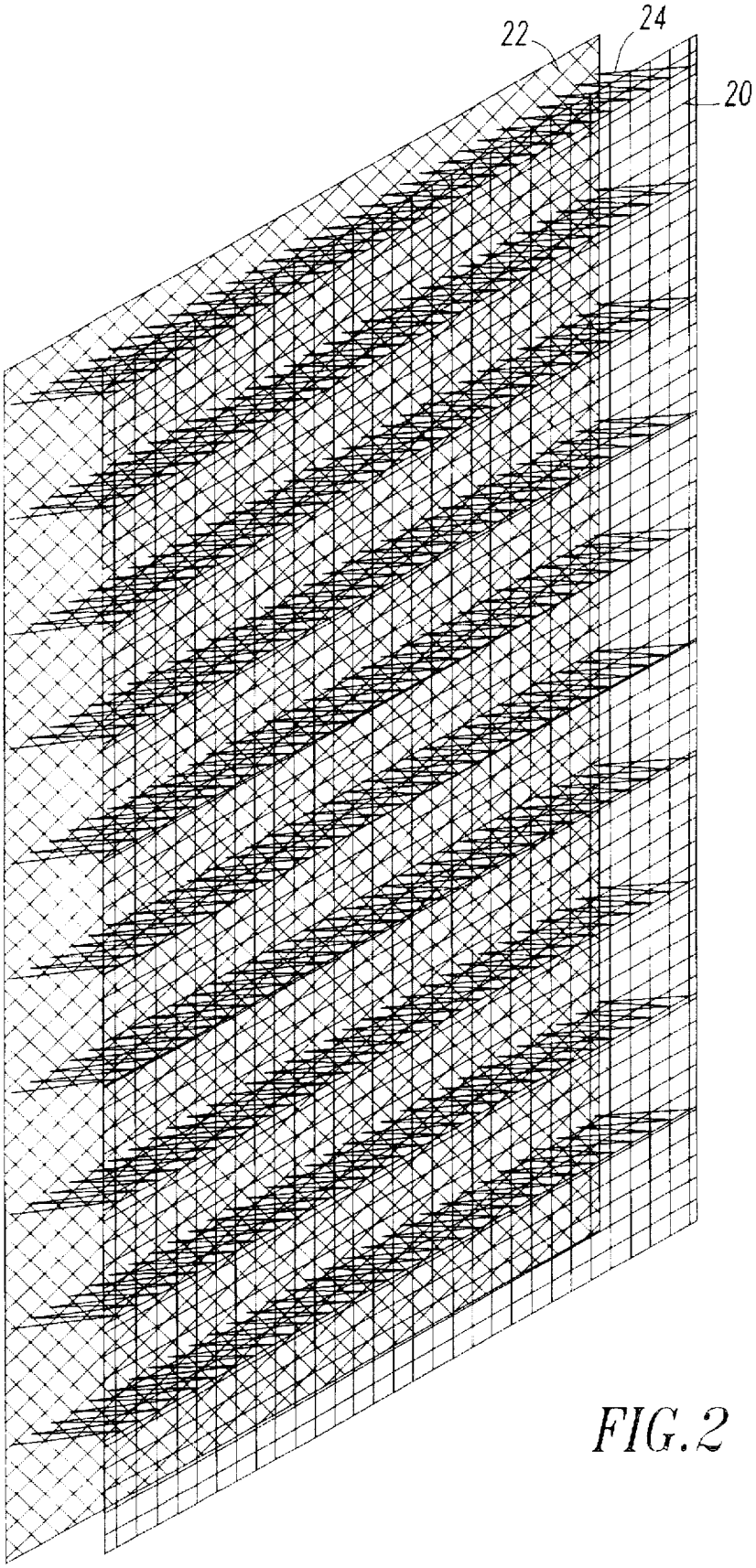
FIG. 2 is a perspective view showing a present preferred embodiment of a honeycomb structure.
Figure 3:
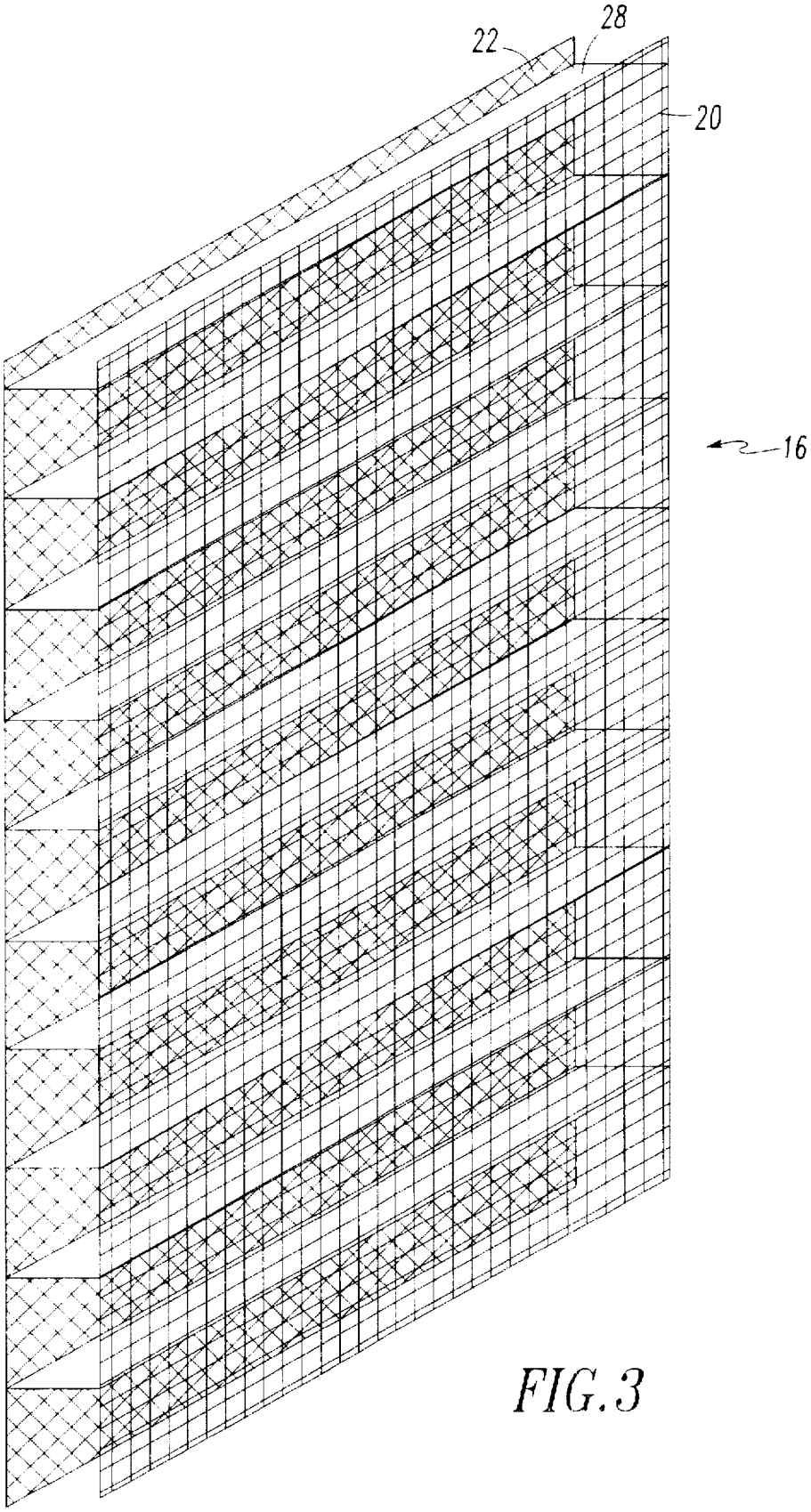
FIG. 3 is a perspective view of a second preferred embodiment of the honeycomb structure.
Figure 4:
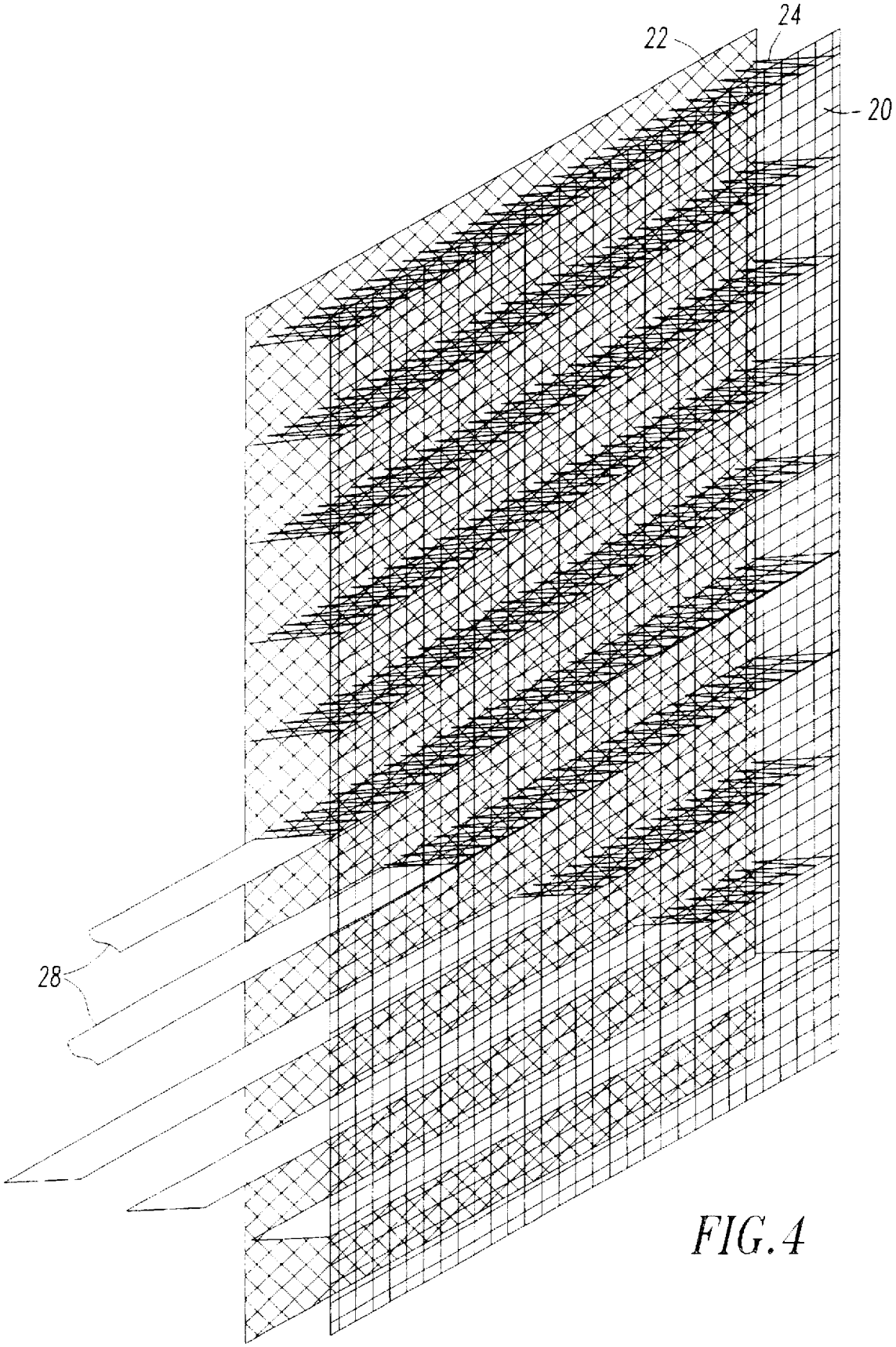
FIG. 4 is a perspective view showing placement of slats to create the second preferred embodiment of FIG. 3.
Figure 5:
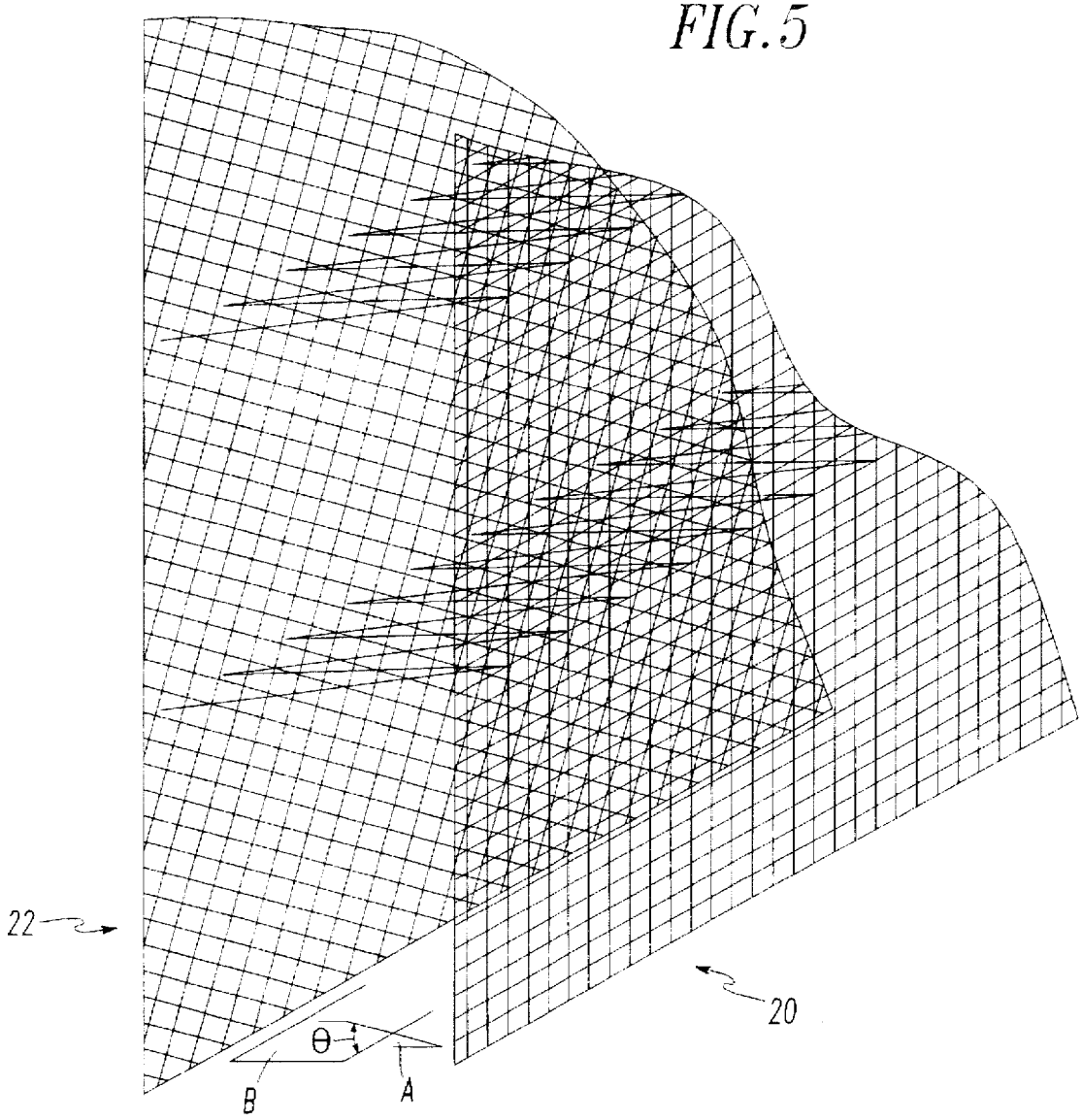
FIG. 5 is an enlarged fragmentary view showing the preferred thread orientation.

As can be seen in FIG. 2, webs 24 are provided at spaced apart intervals between the front sheet 20 and back sheet 22. The webs 24 are formed by drawing at least one warp thread from the front sheet through the rear sheet at each desired location. Preferably, the warp threads from the front will be drawn through the back sheet and warp threads from the back sheet will be drawn through the front sheet to form the web. As shown in the figures the webs will have threads spaced apart a sufficient distance so that light will be able to pass through the web. Although the honeycomb can be made without slats, I prefer to provide opaque slats 28 which are placed on the web as shown in FIG. 4 to form the embodiment 16 of FIG. 3. The slats may be wood, metal, plastic, textile or composite material. As can be seen in FIGS. 2 thru 4, I prefer that the front sheet and back sheet be generally light transmissive. Furthermore, I prefer that the web of the back sheet be oriented so that the base thread and top thread of the web in the back sheet are not parallel to, but at an angle 8 relative to the threads of the front sheet. That is, a plane A passing through a top thread of the front sheet 20 would intersect a plane B passing through the top thread of a back sheet 22 at some angle between 0 and 90°. Preferably that angle B will be 45° as shown in FIG. 5. This type or orientation prevents an unsightly moire effect from developing on the structure when the structure is hung in a window and sunlight passes therethrough.

Figure 6:
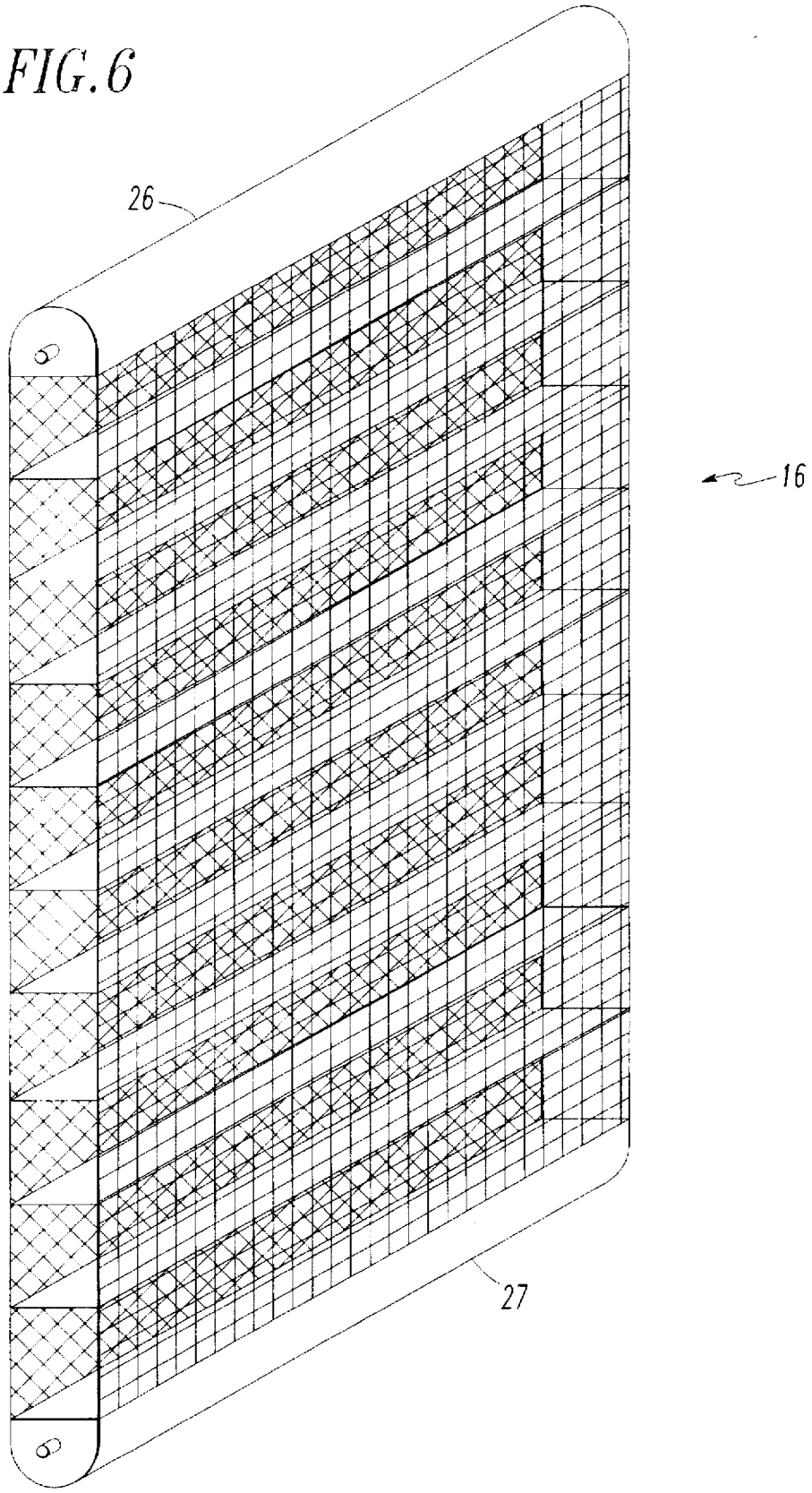
FIG. 6 is a perspective view similar to FIG. 3 showing the honeycomb structure attached to a headrail and bottomrail wherein the structure is in an open position.
Figure 7:
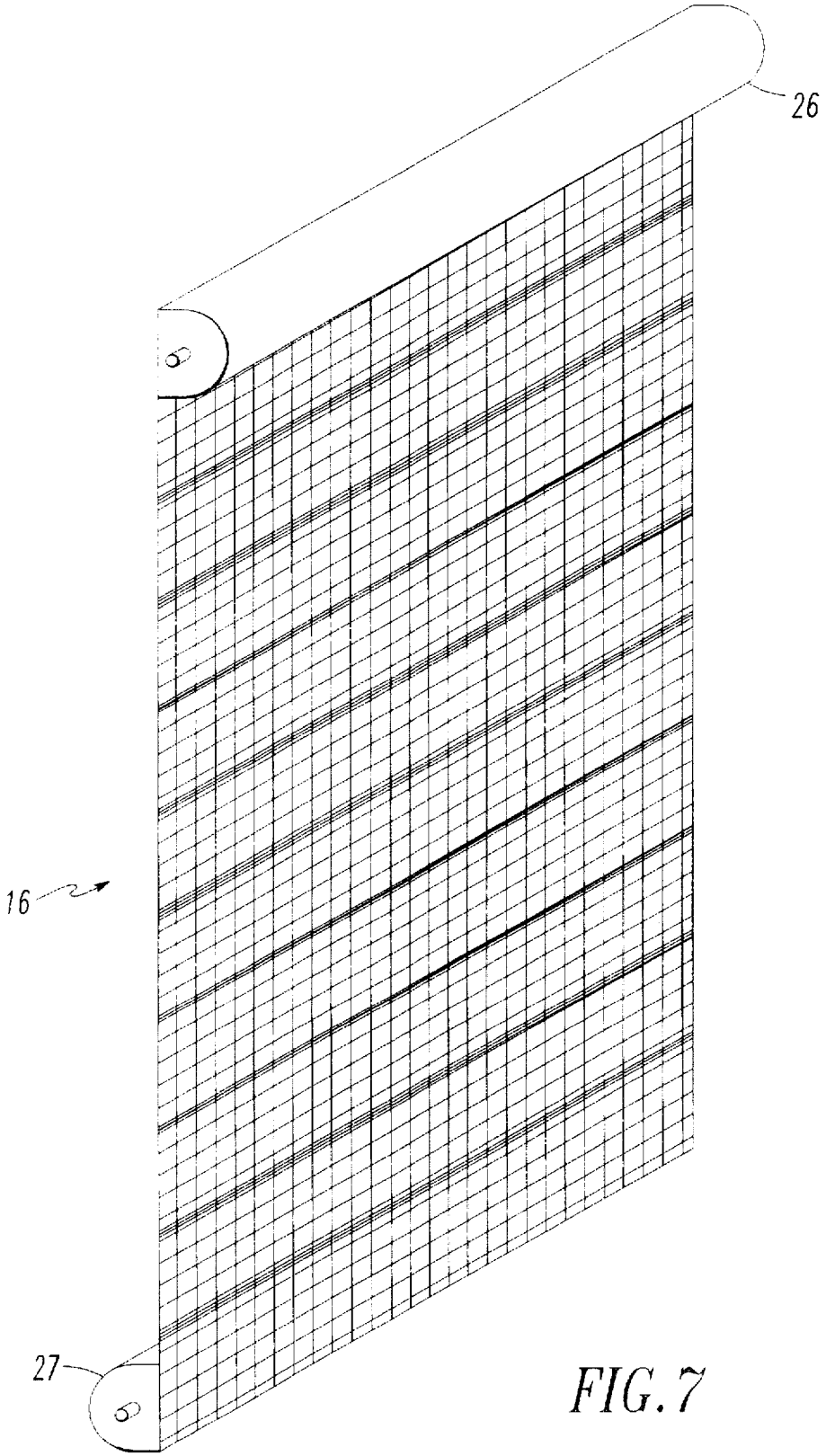
FIG. 7 is a perspective view similar to FIG. 6 showing the honeycomb window treatment in a closed position.

In FIG. 6 there is shown the honeycomb structure 16 of FIG. 3 attached to a headrail 26 and bottomrail 27 to form a window shade there shown in a lowered, open position. By rotating the headrail and bottomrail 26 and 27 as shown in FIG. 7, the front sheet is moved relative to the back sheet so that the honeycomb is in a lowered, closed positioned. In that position the slats are substantially parallel to the front sheet and the back sheet thereby preventing passage of light through the structure.

Figure 8:
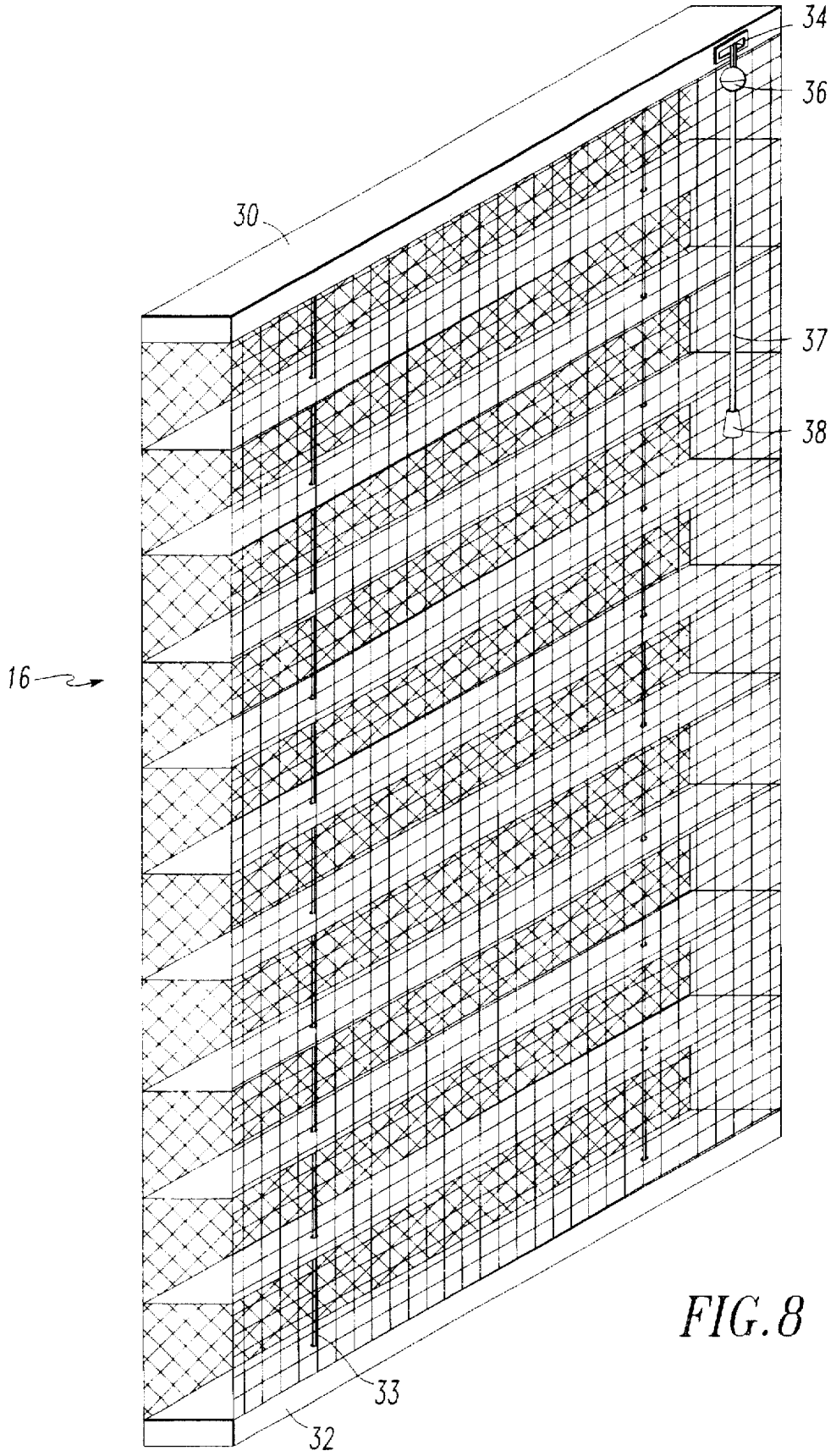
FIG. 8 is a perspective view showing a third present preferred embodiment of my honeycomb window shade in a lowered position.
Figure 9:
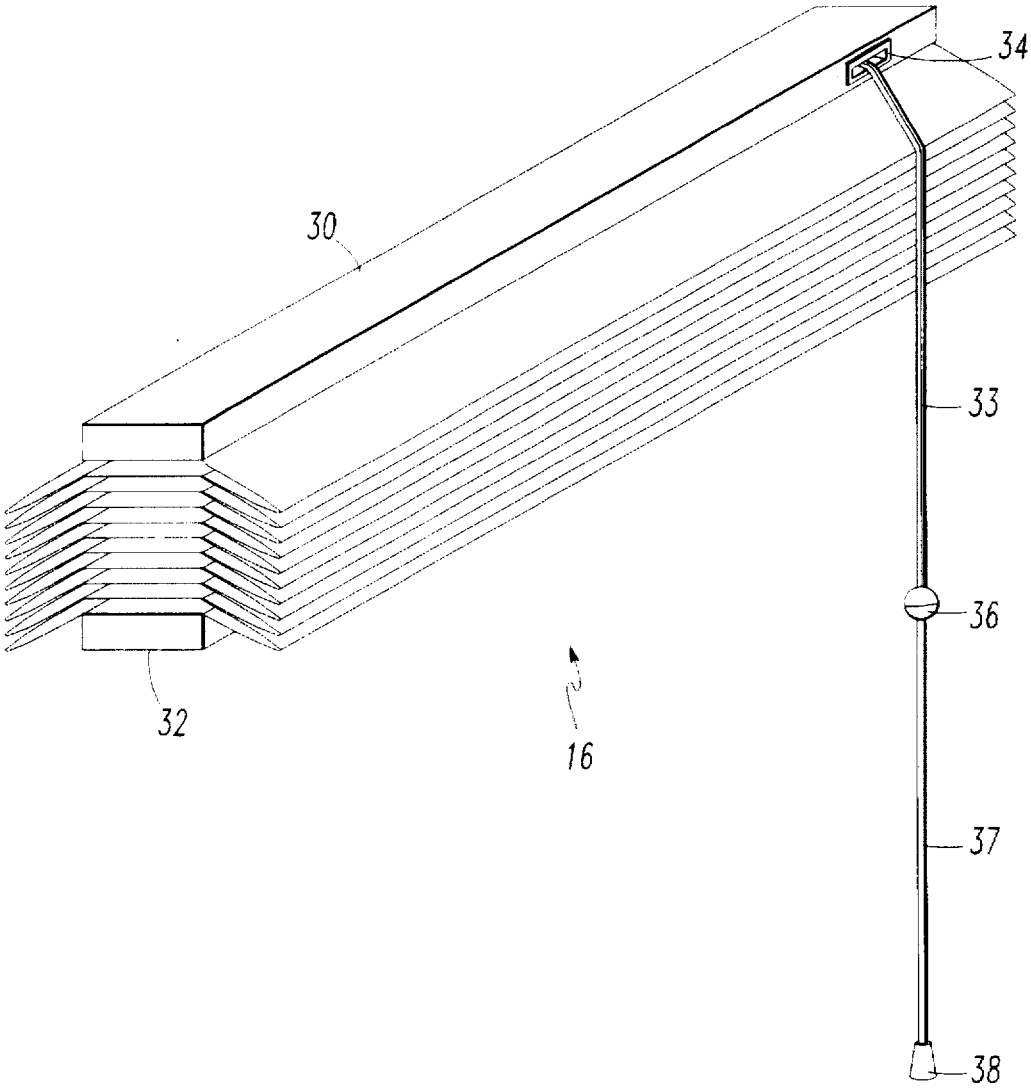
FIG. 9 is a perspective view showing the embodiment of FIG. 8 in a raised position with front and rear sheets folded outwardly.

A second honeycomb shade is shown in FIGS. 8 and 9. There the honeycomb 16 is connected between headrail 30 and bottomrail 32. Lift cords 33 extend from the bottomrail 32 through the headrail 30. These cords pass through a cord lock 34 and are collected at a ball connector 36. A control cord 37 having tassel 38 extends from the ball connector. Because the lift cords are place inside of the honeycomb the front and back sheets 20 and 22 will fold outwardly when the shade is raised as shown in FIG. 9.

Figure 10:
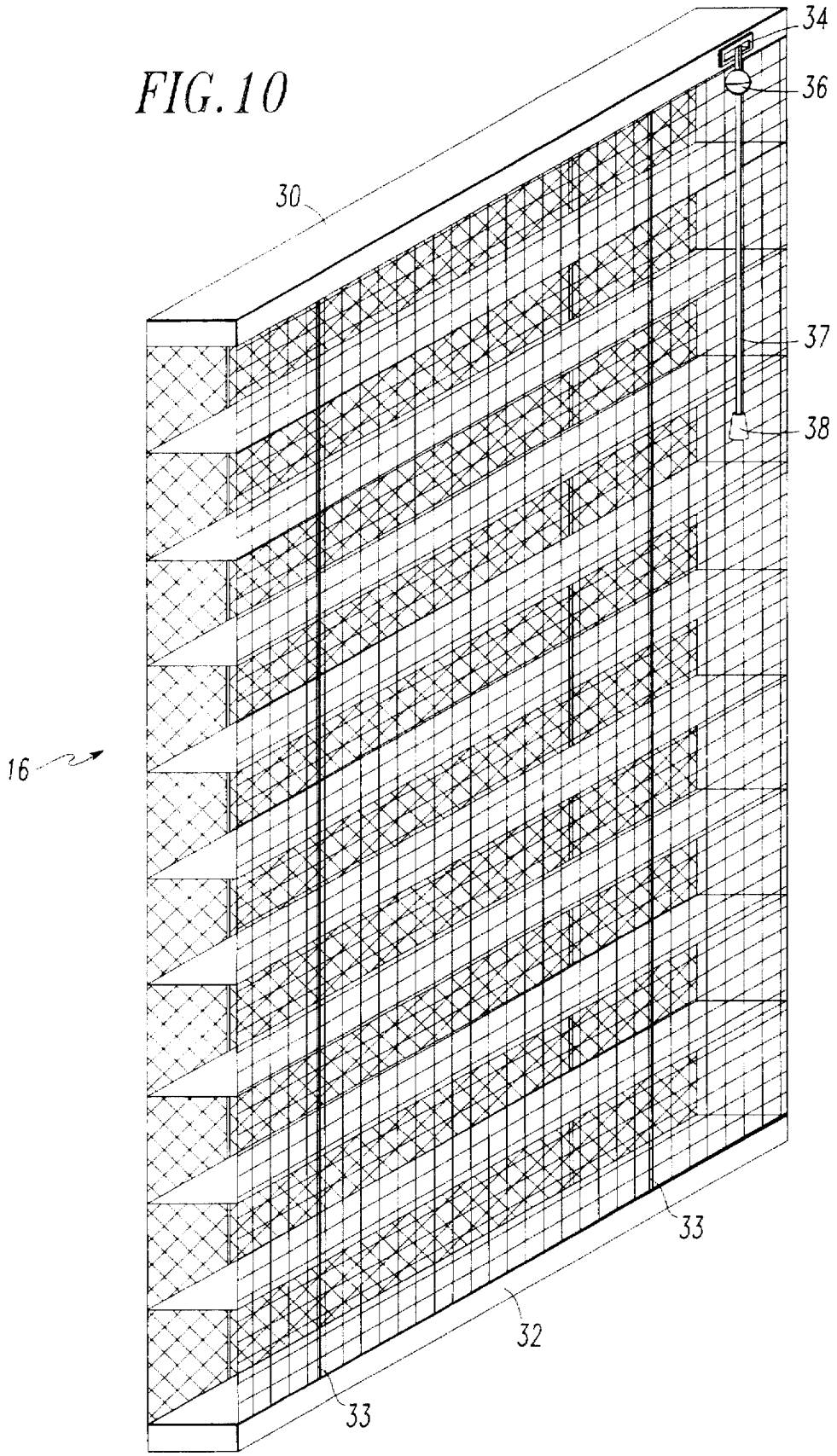
FIG. 10 is a perspective view showing a fourth present preferred embodiment of my honeycomb window shade which has exterior lift cords and is in a lowered position.
Figure 11:
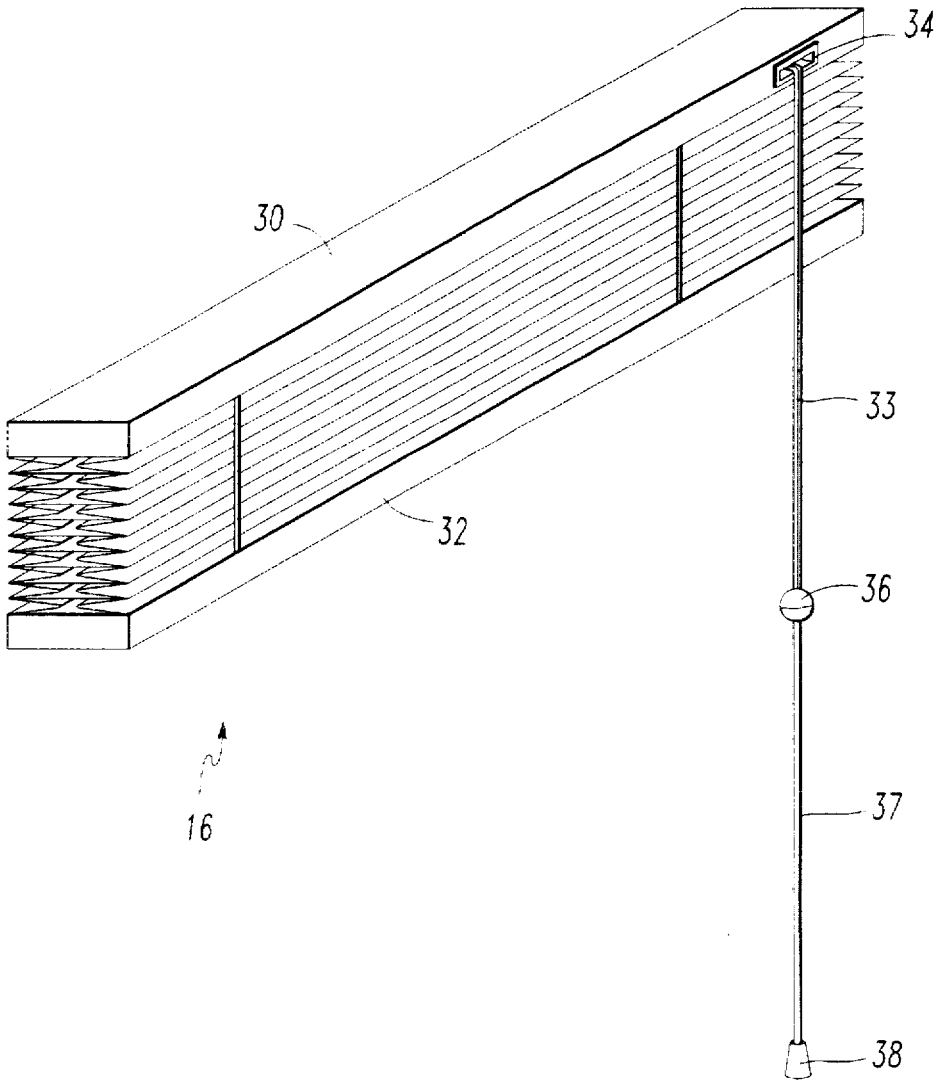
FIG. 11 is a perspective view showing the embodiment of FIG. 10 in a raised position with front and rear sheets folded inwardly.

A third honeycomb shade has the lift cords 33 outside the honeycomb structure 16 as shown in FIGS. 10 and 11. In this configuration the lift cords retain the front sheet 20 and back sheet 22 causing them to fold inwardly when the shade is raised to the position shown in FIG. 11.

Figure 12:
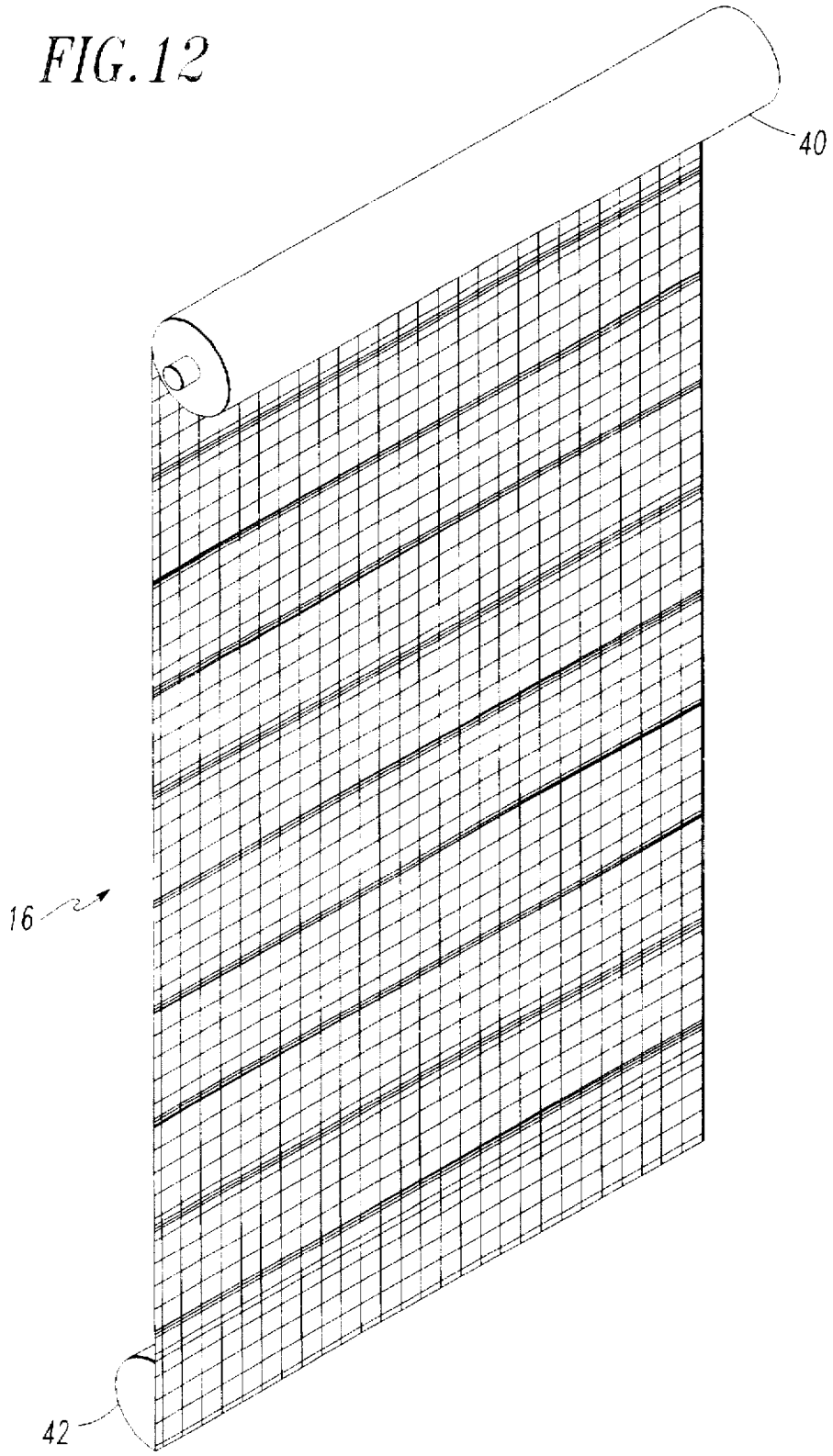
FIG. 12 is a perspective view of a fifth present preferred embodiment of my honeycomb window shade in the form of a roller shade.

My honeycomb structure can also be used in a roller shade by attaching the front sheet and the back sheet to a roller 40 of the type used for conventional roller shades. The front and back sheets are preferably attached along lines defined on the exterior of the roller by a plane passing through a diameter of the roller. When the honeycomb has been fully unrolled the webs will be perpendicular to the front sheet and back sheet so that light can pass therethrough. When the roller is turned 90° or more the webs will be substantially parallel to the front and back sheets as shown in FIG. 1, blocking light passage through the shade. The bottom edges of the front sheet and back sheet are attached in a spaced apart relationship to the bottomrail 42. Therefore, the bottomrail will rotate to the position shown in FIG. 12 when the roller 40 is turned 90° or more.

Figure 13:
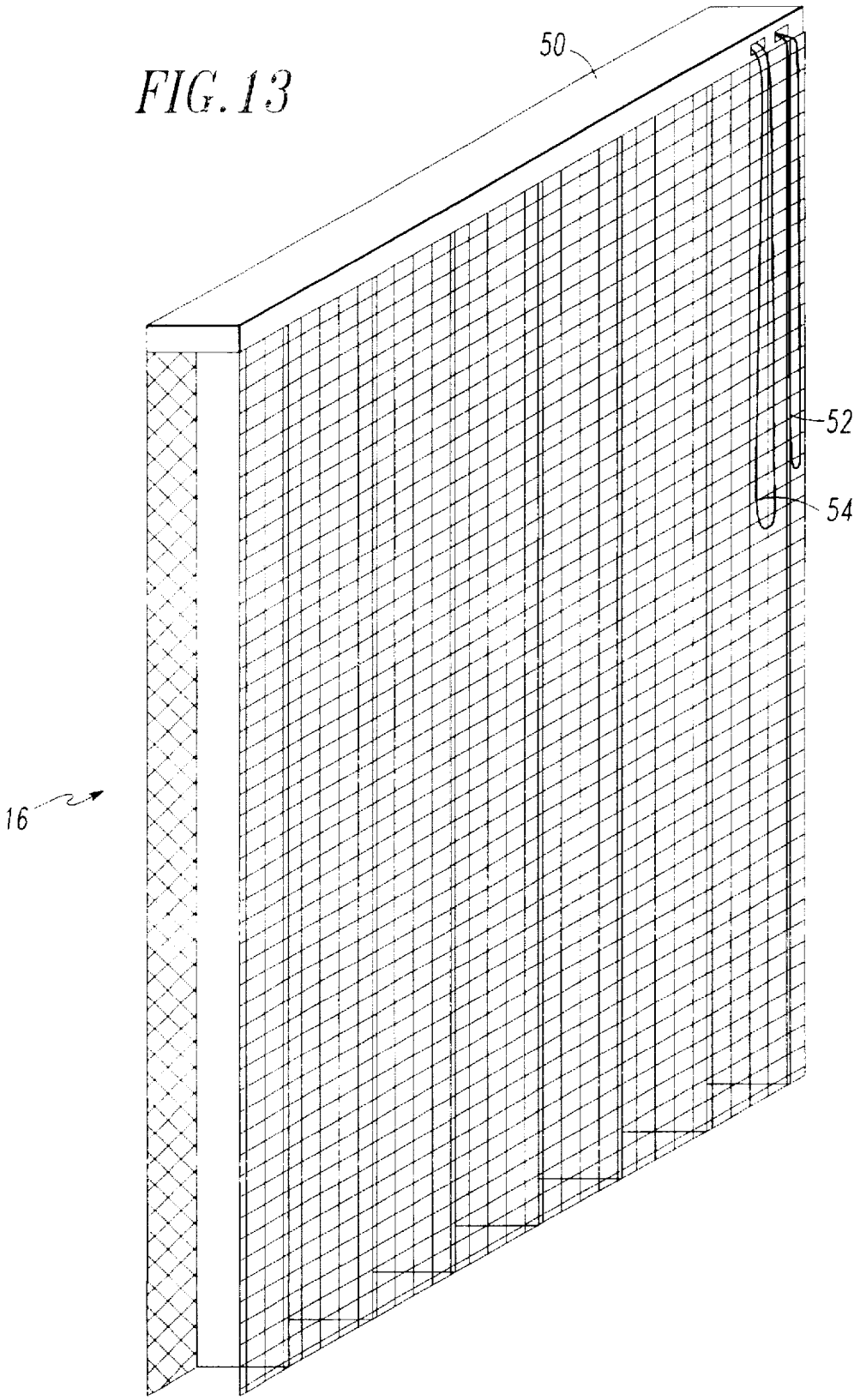
FIG. 13 is a perspective view of a sixth present preferred embodiment of my honeycomb window shade in the form of a vertical blind.

The honeycomb here disclosed can be fabricated into vertical shades. An example of such a shade is illustrated in FIG. 13. There the honeycomb 16 is suspended from headrail 50. A control loop 52 is provided to rotate the webs from a position perpendicular to the front and back sheets to a position substantially parallel to the front and back sheets. Traverse cords 54 are provided to open and close the blind by collapsing or expanding the honeycomb along the headrail 50. Conventional hardware of the type now used for the control loop and traverse cords can be used in this vertical shade. Although not shown in FIG. 13, stabilizers for the sides and bottom of the structure may and probably will be used. Such stabilizers are well known in the art.

Because the front sheet, back sheet and webs of my honeycomb structure are knitted simultaneously it is possible to form a honeycomb structure of any desired length and width. Preferably, the honeycomb structure would be knitted or woven in a standard width such as 36 inches or a multiple thereof. Several hundred feet of honeycomb material can be formed and rolled onto a core. A fabricator cuts the desired length of the honeycomb from the roll. That length is then connected to a selected headrail and bottomrail to form a window covering such is as shown in FIGS. 6 thru 13.

The window treatments shown in FIGS. 6 thru 12 all have slats placed on the webs. However, those slats are not required. One can make an attractive shade using the structure shown in FIG. 2. Indeed, such a honeycomb structure may be better suited for use in some roller shades and vertical shades.

In the window treatments illustrated in the drawings I have shown only a few types of headrail bottomrail combinations with associated hardware. However, other types of headrails, bottomrails, and other hardware can be used.

The honeycomb structure here disclosed can be treated with fire retardants, dyed, cleaned, and otherwise handled in the same or similar ways as other fabric containing window treatments.

Although I have described and illustrated a present preferred embodiment of my honeycomb structure, window treatments made therefrom and methods of making same, it should be distinctly understood that my invention is not limited thereto, but may be variously embodied within the scope of the following claims.

We claim:

1. A method of making a honeycomb comprising the steps of:

a) providing a first mesh;

b) providing a second mesh spaced apart from and substantially parallel to the first mesh;

c) directing at least one first warp thread through the first mesh; and d) directing the at least one first warp thread between the first mesh and the second mesh at selected intervals to create a plurality of webs between the first mesh and the second mesh, thereby forming a honeycomb.

2. The method of claim 1 also comprising the steps of:

a) directing at least one second warp thread through the second mesh; and b) directing the at least one second warp thread between the second mesh and the first mesh at selected intervals to form at least a portion of a plurality of webs between the first mesh and the second mesh.

3. The method of claim 1 also comprising the step of placing a slat on each of the webs.

4. The method of claim 3 wherein the slats are opaque.

5. The method of claim 3 wherein the slats are one of wood, metal, plastic, textile, or composite material.

6. The method of claim 1 wherein:

a) the first mesh is comprised of a set of substantially parallel first base threads and a set of substantially parallel first top threads;

b) the second mesh is comprised of a set of substantially parallel second base threads and a set of substantially parallel second top threads; and c) a plane passing through any selected first top thread will intersect a plane passing through an opposite second top thread at a selected angle greater than 0° and less than 90°.

7. The method of claim 6 wherein the selected angle is 45°.

8. The method of claim 1 also comprising the step of attaching the honeycomb to at least one of a headrail, a bottomrail, or a roller.

9. The method of claim 8 also comprising the step of routing lift cords through the honeycomb.

10. The method of claim 8 also comprising the step of routing lift cords adjacent the honeycomb and extending from the bottomrail into the headrail.

11. The method of claim 8 wherein one of a horizontal shade, a vertical shade or a roller shade are formed.

12. A honeycomb comprised of a front sheet, a back sheet and a plurality of webs therebetween wherein the front sheet is comprised of a first mesh having at least one first warp thread woven therethrough;

the back sheet is comprised of a second mesh having at least one second warp thread woven therethrough; and the webs are comprised of at least one of the first warp thread or the second warp thread.

13. The honeycomb of claim 12 also comprising a slat on each of the webs.

14. The honeycomb of claim 13 wherein the slats are opaque and both the front sheet and the back sheet are translucent.

15. The honeycomb of claim 13 wherein the slats are one of wood, metal, plastic, textile, or composite material.

16. The honeycomb of claim 12 also comprising at least one of a headrail, a bottomrail or a roller attached to the front sheet and the back sheet to form one of a horizontal shade, a vertical shade, a roller shade.

17. The honeycomb of claim 12 also comprising at least one lift cord routed through the honeycomb.

18. The honeycomb of claim 12 also comprising:

a. a headrail attached to the honeycomb at one end;

b. a bottomrail attached to the honeycomb at an opposite end; and c. at least one lift cord routed adjacent the honeycomb and extending from the bottomrail into the headrail.

19. The honeycomb of claim 12 wherein:

a) the first mesh is comprised of a set of substantially parallel first base threads and a set of substantially parallel first top threads;

b) the second mesh is comprised of a set of substantially parallel second base threads and a set of substantially parallel second top threads; and c) a plane passing through any selected first top thread will intersect a plane passing through an opposite second top thread at a selected angle greater than 0° and less than 90°.

20. The method of claim 19 wherein the selected angle is 45°.

* * * * *

UNITED STATES PATENT AND TRADEMARK OFFICE

CERTIFICATE OF CORRECTION

PATENT NO. : 5,753,338

DATED : May 19, 1998

INVENTOR(S) : Ralph Jelic, Ad Verkuyten

It is certified that error appears in the above-indentified patent and that said Letters Patent is hereby corrected as shown below:

Column 6, claim 16, line 43, after "shade," insert --or--.

Signed and Sealed this

Twenty-second Day of September, 1998

*Attest:*

Bruce Lehman

BRUCE LEHMAN

*Attesting Officer*

*Commissioner of Patents and Trademarks*